United States Patent [19]
Cunningham

[11] Patent Number: 4,462,184
[45] Date of Patent: * Jul. 31, 1984

[54] SYSTEM FOR IMPROVING SYNTHETIC SURFACES

[76] Inventor: Percy C. Cunningham, 3545 Wellington Crescent, North Vancouver, British Columbia V7R 3B3, Canada

[ * ] Notice: The portion of the term of this patent subsequent to May 26, 1998 has been disclaimed.

[21] Appl. No.: 266,475

[22] Filed: May 22, 1981

Related U.S. Application Data

[63] Continuation-in-part of Ser. No. 40,194, May 18, 1979, Pat. No. 4,268,993.

[51] Int. Cl.³ ..... A01G 31/00; E02B 11/00
[52] U.S. Cl. ..... 47/58; 47/1 R; 47/2; 272/3; 405/37
[58] Field of Search ..... 47/58, 1, 48.5, 2, 56; 405/37–38; 111/1; 273/29 R; 272/3

[56] References Cited

U.S. PATENT DOCUMENTS

| | | | |
|---|---|---|---|
| 2,947,109 | 8/1960 | Davis et al. | 47/1 |
| 4,023,506 | 5/1977 | Robey | 47/56 X |
| 4,044,179 | 8/1977 | Haas | 273/29 R X |
| 4,268,993 | 5/1981 | Cunningham | 47/1 R X |

FOREIGN PATENT DOCUMENTS

| | | | |
|---|---|---|---|
| 482615 | 7/1953 | Italy | 405/38 |

*Primary Examiner*—Robert E. Bagwill
*Attorney, Agent, or Firm*—Cole, Jensen & Puntigam

[57] ABSTRACT

A synthetic surface, such as artificial turf, rubberized asphalt, concrete composition, particulate mixtures and the like, is applied on top of a subsurface base system, which in turn is on top of a subgrade. A liquid impervious membrane is positioned between the subgrade and the base system. The base system comprises an upper layer of sand-containing particulate material in which liquid characteristically moves in the vertical direction and a lower layer of gravel in which liquid characteristically moves well in the horizontal direction as well as downwardly. The material of the upper layer does not significantly penetrate into the gravel. The base system has a non-rutting upper surface. The non-rutting surface is accomplished by planting grass, cutting the grass at least once, and then killing the grass. The synthetic surface is then applied. A conduit system is positioned in the lower gravel layer of the base system, and a water reservoir is established in the base system. In warm temperatures, the synthetic surface can be cooled by maintaining the upper layer of the base system moist, and by circulating cool water into the reservoir and withdrawing warm water therefrom. Conversely, in cold temperatures, warm water can be circulated into the reservoir and colder water therein removed.

22 Claims, 14 Drawing Figures

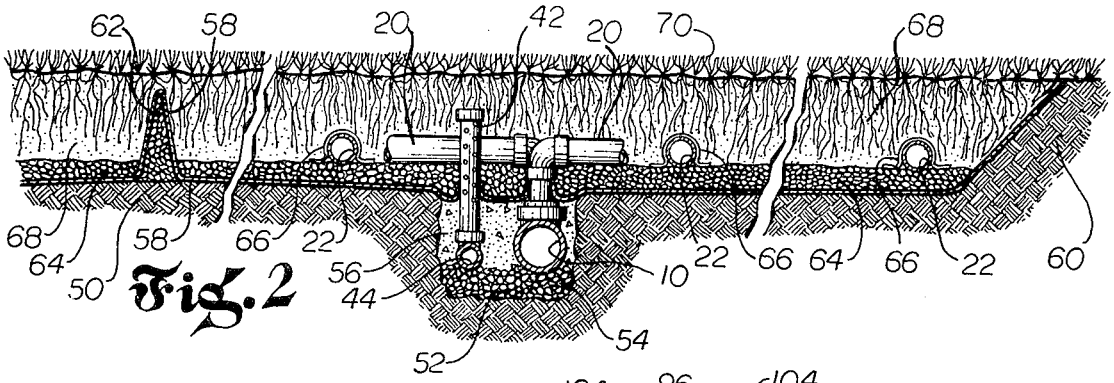
Fig. 2
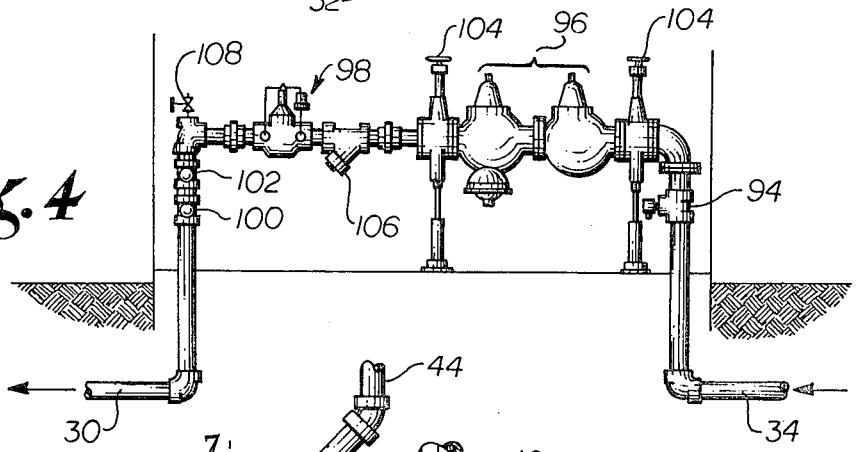
Fig. 4
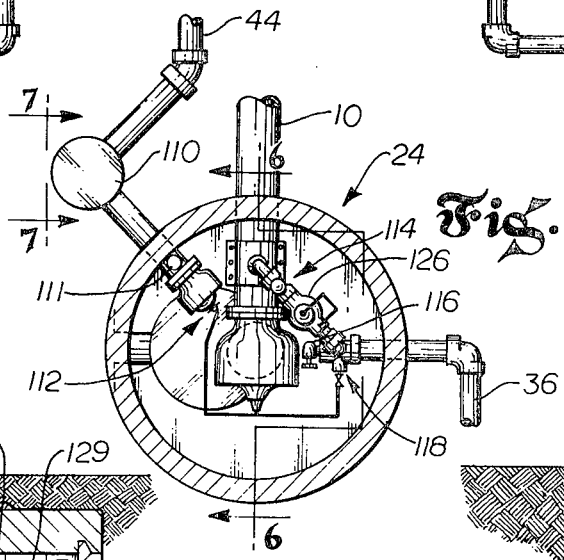
Fig. 5
Fig. 6
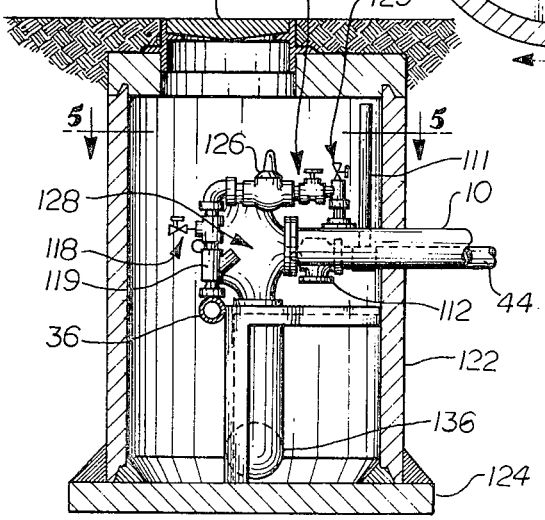
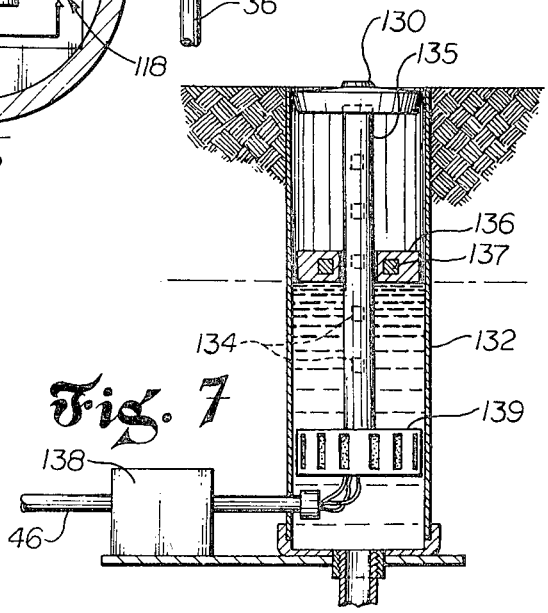
Fig. 7

SYSTEM FOR IMPROVING SYNTHETIC SURFACES

BACKGROUND OF THE INVENTION

This application is a continution-in-part of patent application Ser. No. 040,194, filed May 18, 1979, now U.S. Pat. No. 4,268,993 in the name of Percy C. Cunningham, titled: Grass Sports Surfaces and a Method For Maintaining Them.

As is well know, the construction of a good quality all weather grass playing surface and its maintenance for recreational purposes and active sports, such as soccer and football, has been a problem of long standing.

One of the more recent attempts at resolving this problem has resulted in use of an artificial surface. These surfaces have reduced the regular maintenance required but the cost to repair for wear and tear generally exceeds the cost of maintenance of a natural grass field. Further, the playing conditions immediately over a synthetic surface are far less tolerable than over a grass surface since the synthetic and its supporting surface retain heat. All synthetic surfaces have suffered from the inability to provide adequate drainage. In general, these synthetic surfaces are not completely acceptable to player associations since they have a higher incident of injury than that experienced on a good quality natural grass surface.

In general, the factors which must be considered in designing and maintaining a playing surface include the needs of the player utilizing the surface, the requirements of the agrologists in plant growth and maintenance and the correct application of acknowledged engineering principles. The finished product will experience variable and sometimes unpredictable environmental considerations. The total growth and maintenance system must have a flexibility built into it such that the variables may be accommodated.

The selected grass used must be of a type which has good wear ability characteristics, but also must satisfy the climatic conditions in the locality where it is to be used. Once the selection has been made as to the seed mixture, the plant itself must be established and must be capable of vigorous growth to provide for rapid self-repair following user damage. The grass must be well anchored in its growing medium to minimize tear out by the participant and it should provide a uniform surface throughout the applicable season.

It is desirable that the quality of the surface be constant for the entire grassed area and that the surface be able to be used extensively even under adverse climatic conditions. This desire obviously requires the surface be free from an accumulation of water and frost and that the watering and fertilization application do not interrupt use. The ground conditions should be firm and yet provide a cushion normal for a well established turf which experience has shown to minimize player injuries.

It is further desirable that the playing area should be free from obstructions such as sprinklers or the like and reasonably level throughout its entirety.

Maintenance personnel require a minimization of the operational function needed to maintain the surface while retaining a good quality grass condition.

PRIOR ART

In general, grass surfaces heretofore provided can be generally classified as the soil turf field, the modified sand field and the membrane sand field.

The soil-turf playing surface is a classical method wherein the growing medium is a natural good quality soil placed over a granular material. Drainage is provided by providing a crown to the surface and subsurface drains. Irrigation is applied to the surface by conventional methods. Fertilizer is generally applied to the surface through mechanical spreading or through sprinkler applied liquid fertilizer.

These soil-turf fields in general do not stand up to more than minimal use and require heavy maintenance. In wet locations, these fields are consistently muddy due to poor drainage characteristics whereas in dry conditions, the grass shows the affect of the heat and in general are not well nourished. In hot locations, surface applied irrigation experiences large evaporation losses to atmosphere and a build up of water borne impurities at the surface damages the grass. Surface compaction caused by the natural rainfall, surface irrigation and player use generally renders the drainage system ineffective. The compaction also prevents oxygen from reaching the roots and inhibits growth. The surface runoff attempted by crowning the field is not rapid enough even under minimal rainfall. The grass plants are generally surface hugging because of the fact that the water, nutrients and oxygen required are all located there. In this weakened state, the grass may be easily pulled out during normal play, creating bare areas which are not readily self-repairable and require extensive resodding. A weakened grass is more susceptible to disease and infestation problems. This method does not lend itself to soil warming techniques since the melted frost and snow aggravates the lack of drainage and turns the surface to mud. In cold climates, the surface freezes rapidly due to the high slit content and its moisture retaining characteristics.

The inadequacy of the soil turf method has led to development of both the modified sand and the membrane sand methods. In each of these cases, the primary attempt is to overcome the drainage and compaction problem.

The modified sand method uses two classifications of sand as a growing medium, i.e. a bottom layer of natural clear sand while the top surface is a mixture of sand and organics. Drainage is provided by an underlying grid and irrigation and fertilizers are surface supplied by the same means as for soil turf method.

The modified sand method has essentially uncontrolled drainage through the sand layer and therefore the modified surface zone is essential to avoid drought conditions at the level of plant growth. Although the addition of organics retain the nutified moisture and oxygen relation in the surface layer for good plant growth, the organics also retain water, slow down the drainage rate and result in a soft and slippery surface. The grass is surface hugging for the same reasons as the soil turf field. A major problem is this method is lack of long term control. The surface zone, although selected for proper liquid retention characteristics at the time of design, is subject to normal decomposition and leeching of the organics resulting in their loss through the drainage system. Further, the decomposition of the organic material consumes nitrogen necessary for strong healthy growth. The eventual replacement of the organics is impossible without entire replacement of the surface layer, an expense similar to resodding for the soil-turf field. The effectiveness of soil warming techniques to remove snow and frost are inhibited by the lack of the systems ability to continuously replace lost moisture caused by the cold weather drying effect. The surface condition results in freezing conditions similar to the soil turf field.

The membrane sand method is the result of efforts to capitalize on the principles of hydroponic growth, which has proven to be totally successful with a controlled propagation of plants in a nursery environment. Although variations exist, in general, the membrane sand method comprises of a natural sand growing medium which is completely isolated by an impervious membrane to provide a contained reservoir of water and isolate the area. Over the membrane and within the isolated area is placed the pipe or conduit system which is tied into a drainage discharge system located outside the field area to allow removal of excess water. Over and around the pipes are placed sand and the regulation of the excess drainage discharge is provided by some form of weir like action or pumps or both.

These systems have not been adequately designed to properly handle sub-surface applied irrigation or fertilizer and generally those installed use surface sprinkler systems and fertilizer application by means similar to the soil turf and modified sand methods. The majority of installations have also used a modified surface zone by including a layer of organics. This effect minimizes the capillary action (a benefit of the membrane) since capillary rise will not readily transfer from the pure sand to the modified sand thus creating a barrier and necessitating supplementary surface applied irrigation and fertilizer. Those with perforated distribution pipes placed directly on the plastic membrane are impaired since the standard location of the perforation holes and the normally expected one inch ground settlement after construction causes some of the pipes to indent into the plastic blocking the holes and making them ineffective. Pumps used to assist in the removal of excess drainage water are ineffective when the water table is below the entry parts of the pipes due to loss of vacuum. Installations using special piping cross joints have shown irregular drainage capabilities due to restricted flow. Systems using only sand exhibit poor lateral liquid movement to or from a pipe system and require a larger head pressure for drainage. Under certain conditions, the head requirement results in a saturation curve within the sand that will intersect the surface between the pipes and cause surface puddling. Conversely, liquid attempting subsurface entry into the field is restricted in uniformity of distribution unless sufficient pressure is used which could then lead to a quick sand condition in the areas of the initial entry points. None of the systems exhibit positive and responsive control systems.

Although a search has not been made, U.S. Pat. No. 3,461,675 granted to Izatt on Aug. 19, 1969 is illustrative of the type of system described hereinabove and improved upon by the present invention.

PRESENT INVENTION

The important criteria of this improved membrane sand system is to provide and maintain a deep rooted grass surface which exhibits vigorous growth and which has a level surface throughout without obstructions and which does not suffer compaction problems. The system is capable of minimizing environmental problems created by variable climatic conditions of the various locales in which it is installed includes effective surface drainage abilities as well as nutrified liquid replacement to the plants growing zone on a uniform and continuous demand basis as the plant and climatic conditions dictate. Soil warming techniques for frost and snow melting create surface drainage and plant drying out effects and the system is capable of handling these factors.

The prime consideration of this improved membrane sand system is to control the water table within the isolated membrane area and the assurance of uniformity of lateral distribution of the nutrified liquid reservoir such that the surface zone moisture content is maintained. This control and distribution ensures the proper relationship of nutrified water and oxygen for the particular sand type and within the tolerance limits for the plant. Water and nutrients, whether applied by subsurface means or at the surface, move freely to the membrane reservoir by the excellent vertical drainage characteristics of the sand. This reservoir in turn feeds the grass plant by capillary action inherent with the sand. Excess water occuring during rainfall is discharged out of the system, conserving first any rain water that can be retained for irrigation purposes. Irrigation water make-up is preferably applied through the utilization of a subsurface pipe grid utilized for both the drainage and the irrigation or may be applied by conventional surface means. Fertilizer is added to the irrigation water using liquid fertilizers and an injection system or may be surface applied.

It has been well demonstrated that depending upon passage of time and as a characteristic of a selected sand, the sand absorbs the same amount of liquid whether or not it is applied at the surface or from beneath. It can also be easily demonstrated that the absorption of the sand is proportional to its depth and the moisture content at any level can be determined as a function of the depth of a particular gradation of sand.

The capillary rise in the sand, in addition to the drainage characteristics, is dependent upon the gradation and makeup of the sand and is controllable by proper selection of these materials and the establishment of a water table. The rate of capillary rise is particularly critical in extremely dry climates and the drainage rate is critical in areas of heavy rainfall. It is also required that the selection of the gravel be such that its gradation, in comparison with that of the particular sand, be compatible to ensure that the sand will penetrate the gravel layer by a depth of approximately one inch. This penetration places the bottom of the sand layer below the minimum water table to allow capillary action and yet the lateral flow characteristics of the gravel are not impaired.

It can thus be seen that maintaining a water table at the bottom of a natural sand layer permits the more accurate control of the moisture content at the growing level. Further the natural sand surface extends the playing season by its low moisture retention and thus its ability to hold back freezing for a slightly longer period and to thaw out more rapidly. The dormant period of the plant is thus reduced. The addition of a uniform heat source, combined with the proper seed selection, may further extend the season by encouraging early growth and resisting die back caused by cold. The inclusion of an insulation layer under the membrane will minimize frost penetration to the subgrade at times when the heating system is not in use.

In summary, an accurately controlled, frequently watered, properly fertilized well drained field provides for the best quality grass playing surface as well as encouraging rapid regrowth and thus providing maximum utilization. Healthy plants are less susceptible to disease and infestation and a natural grass surface provides much lower air temperatures immediately over the playing surface than the prevailing ambient conditions while providing the immediate air with an enrichment of oxygen. Only this improved membrane sand method with automatically operated subsurface drainage and fertilization in combination with irrigation, i.e. "fertigation," provides these requirements on a continuous demand basis as determined by the plant and the environment. The grass itself, in growing, has a deep rooted characteristic as it reaches down to the water table and thus has better wear and tear capabilities, since the plant is more firmly anchored and thus suffers only leaf damage during extensive use which is rapidly replaced by vigorous regrowth. The utilization of "fertigation" by subsurface application is a continuous, uniform and steady means which when coupled with the membrane isolated area, carefully selected growing medium and liquid transfer medium and system coupled with accurate and responsive control method provides these requirements.

It is an object of the present invention to provide a playing surface support material and method which maximizes the utility of a field and minimizes the maintenance requirements under the most variable and severe climatic conditions.

Still a further object of the present invention is to provide a system for establishing and maintaining a grass play surface comprising the steps of: (1) grading the subgrade at the site of the proposed surface, (2) placing a fluid impermeable membrane adjacent the graded surface with or without inclusion of an insulation layer, (3) providing a means of central supply and removal of fluid at the appropriate location in the graded surface, (4) providing a layer of horizontal flow gravel on top of the membrane, (5) placing a lateral liquid distribution system throughout the desired area on top of the gravel layer, (6) providing a layer of sand with appropriate permeability, capillary and porosity characteristics and having a substantially level upper surface without obstructions into which the grass will be planted, (7) provide a means exterior to the field to direct excess drainage water from the field to the site storm system, (8) providing a responsive control system to control the liquid level within the confines of the membrane beneath the grass, (9) provide an adequate fertilizer injection and water make-up system to sustain optimum growth and replace transpired and evaporated water, (10) provide a drain line to remove all liquid from the contained reservoir, (11) when required, installation of a soil warming system to melt snow and remove frost, (12) when required, to provide a means to sense the nutrified condition of the contained liquid.

Still another object of the present invention is to provide a membrane sand type grassed sports surface including automatic means to provide irrigation as needed, provide fertilizer on a predetermined schedule, and to withdraw liquid from the field in the event that the level within the membrane exceeds the maximum desirable for optimal utilization of the field while maintaining the quality and quantity of nutrified liquid to stimulate healthy growth.

It is another object of the pesent invention to provide a grass playing field which includes a growing medium having predictable capillary action overlying a liquid containing material having horizontal flow characteristics assuring uniformity of distribution under low infeed pressure requirements in which are placed conduits for the addition of water and fertilizer to the liquid reservoir.

A still further object of the present invention is to provide a grass supporting medium wherein the upper layer provided a firm noncompacing surface with predictable permeability permitting ready drainage and an underlying surface permitting lateral fluid movement such that a minimum head is required to effect the drainage.

Still another object of the present invention is to provide a means located within the field beneath the grass sports surface for determining the level of liquid within the grass supporting medium interconnected with a means exterior of the field to provide ready and convenient information as to the liquid level.

It is another object of the present invention to provide a means and mechanism to sense the system's water level and magnetically transmit this into low voltage electrical signals and relays these to a programmable control panel which, in turn, operates, using a low voltage power supply, the irrigation infeed and drainage outflow valves. The system utilizes available irrigation water pressure to function the main valves through small solenoid valves located on the bleed lines from the irrigation line. This method thereby minimizes any electrical hazard.

It is another object of the pesent invention to provide a means and mechanism when electrical energy is not available to use float operated devices activated by the systems water table and coupled to the irrigation bleed line valves to transmit the irrigation pressure into a force to open or close the irrigation and drainage valve.

A further object of the present invention is to provide a means and mechanism for extending the usable season for a playing field through the use of underground heaters and protective sub-grade insulation layer combined with a system which accommodates the generated drainage requirements while simultaneously providing a continuous source of liquid to avoid the drying effect normally associated with artificial heating devices.

Yet a further object of the present invention is to provide a grass field which may have a chemical inbalance corrected without resorting to a restructuring or replacement. A drain and irrigation system is provided such that all chemicals or the like may be easily washed by means of purging from the grass supporting medium effecting a neutral condition. It is also the object of the drain to allow removal of all liquid from the entire system when necessary.

BRIEF DESCRIPTION OF THE DRAWINGS

FIG. 2 is a sectional view taken along the lines 2—2 of FIG. 1.

FIG. 4 is an elevational view of the water supply header as seen along lines 4—4 of FIG. 3.

FIG. 5 is a plan view of a valve station.

FIG. 6 is an elevational view of a valve station.

FIG. 7 is an elevational view of the electrically sensed level control unit.

DETAILED DESCRIPTION OF THE DRAWINGS

Figure 1:
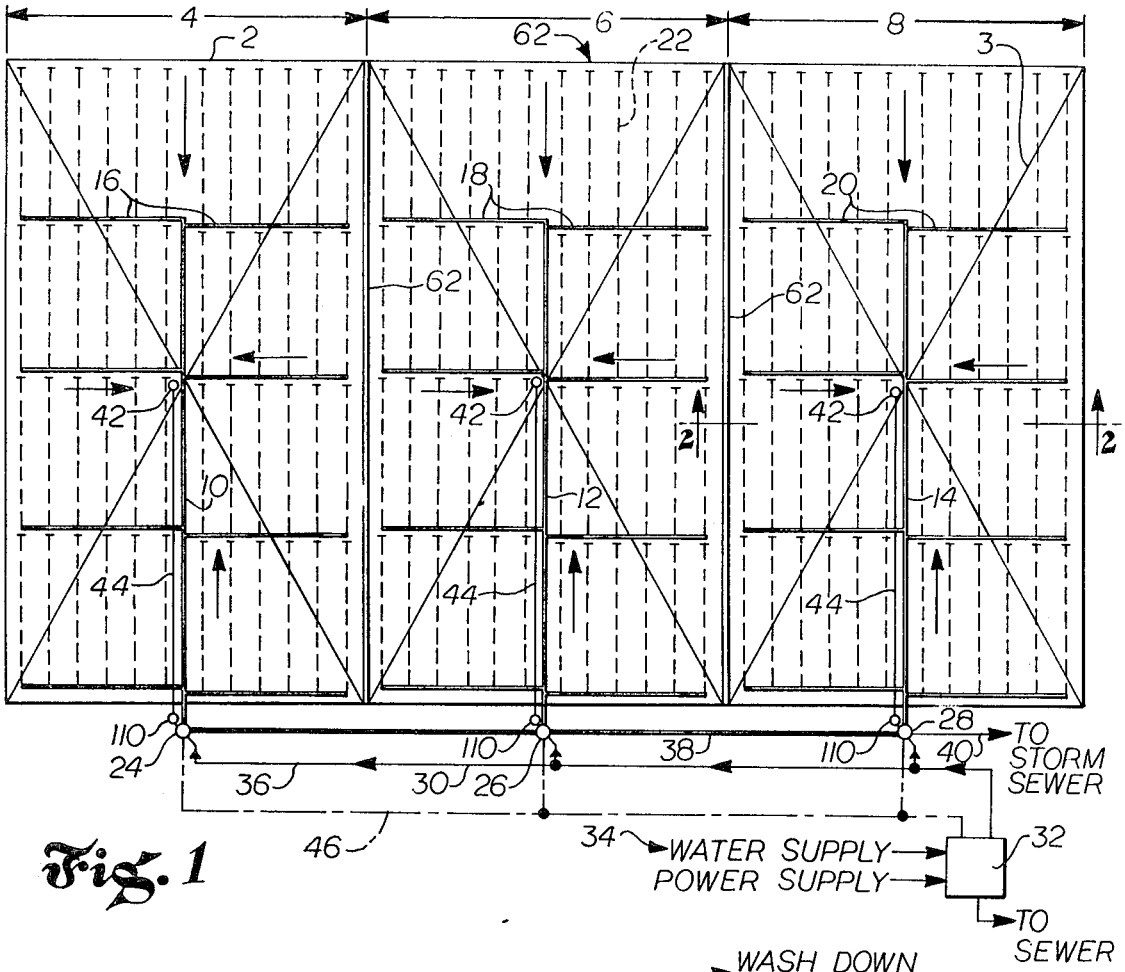
FIG. 1 is a plan view of a typical field layout utilizing the present invention.

As seen in FIG. 1, the field generally designated as 2 is divided into three essentially equal sections 4, 6 and 8 and defined internally by a division along lines 62. It is to be understood that the size and shape of the field as well as external conditions such as climatic factors and degree of use will determine the number and shape of the sections. Each section has a slope in the sub-grade designated in diagonal lines 3 to a low point at approximately the center of the section where the water level detector 42 will be located as explained hereinafter. Within each section of the field there will exist a field section main 10, 12 and 14 interconnecting with the required number of horizontal field distribution piping headers 16, 18 and 20. A plurality of perforated field distribution pipes 22 form a substantially equally spaced grid work throughout the field assuring reasonably equal distribution and/or saturation.

Each of the sloping field section mains 10, 12 and 14 are connected to a valve station 24, 26, 28 located below grade outside the playing area and are interconnected by means of an irrigation feed system 30 which is interconnected with and controlled from the control room 32 which in turn is connected to the water supply 34. These field distribution pipes 22 and the headers 16, 18 and 20 as well as the mains 10, 12 and 14 may also be used to discharge excess water by means of the drainage system 36, 38 and 40 which lead to an off site storm system. It is to be noted that the water level detector 42 and its interconnected tube 44 (one for each section) likewise is interconnected with the valve station and with a storm drain after passing through the water level sensing unit 110. Also seen in this view is the low voltage electrical control system designated generally as 46 from the control room to each one of the valve stations.

Referring now to FIG. 2 which, as noted above, is a vertical sectional view taken along lines 2—2 of FIG. 1, it can be seen that the field includes a subgrade 50 which slopes within each section towards its center and the water level detector 42 which can also act as a drainage means. At midpoint of each section is located the trench 52 to accommodate the piping exiting for each section and includes sand bedding 54 supporting the field section main 10. The water table level tube 44 is also placed within trench 52 which is terminated at the center of the section with a vertical perforated tube designated as the water level detector 42. The remainder of the trench is filled with onsite material 56 and a membrane 58 is placed over the sub-grade and sealed at the conduit entry points thus establishing an enclosed dish-like area for the irrigation and grass support purposes. As the trench exits the perimeter of the system a 5 foot long plug using impervious materials is inserted in the trench to ensure a positive seal to the trench itself.

As noted above, the entire field is broken into field sections. The field sections are defined by a perimeter berm 60, which extends around the entire periphery of the field, and upwardly extending section divisions 62 extending across the field and across which the membrane 58 is folded. The subgrade 50, as noted above, is sloped toward the center of each section but the gravel layer 64 which lies thereupon and supports a perforated field distribution piping 22 as well as the piping headers 20 has a horizontal or level upper surface. It is to be noted that this surface in general will define the minimum water level through the weir action of the perforations in the event of automatic control shutdown. The gravel layer with horizontal flow characteristics assures even distribution of water or fertilizer.

The perforations of the field distribution piping are placed downwards on top of the gravel and the pipes are then covered with a filter cloth wrapping 66. This cloth is standard to earth work projects and prevents the fines loss from the sand from entering the piping system. The pipe is not entirely wrapped but is covered with the filter cloth which is then tucked on each side of the pipe with the edges projecting outward by three or so inches. This method of wrapping is essential since wrapping the pipe on its entire circumference could lead to clogging through salted out fertilizer particles being trapped in the filter material 66. The method employed allows the holes to remain uncovered while the sand is prevented from entering the pipe without first passing through the gravel 64. This is not possible because of the particular selection of the gravel gradation. The sand layer 68 is then placed, overlying the gravel and the distribution piping. The grass 70 is planted at the top of the sand layer at the field elevation which is level throughout. The root structure will generally extend vertically downwardly to reach the established water table and not bunching toward the pipes.

Figure 3:
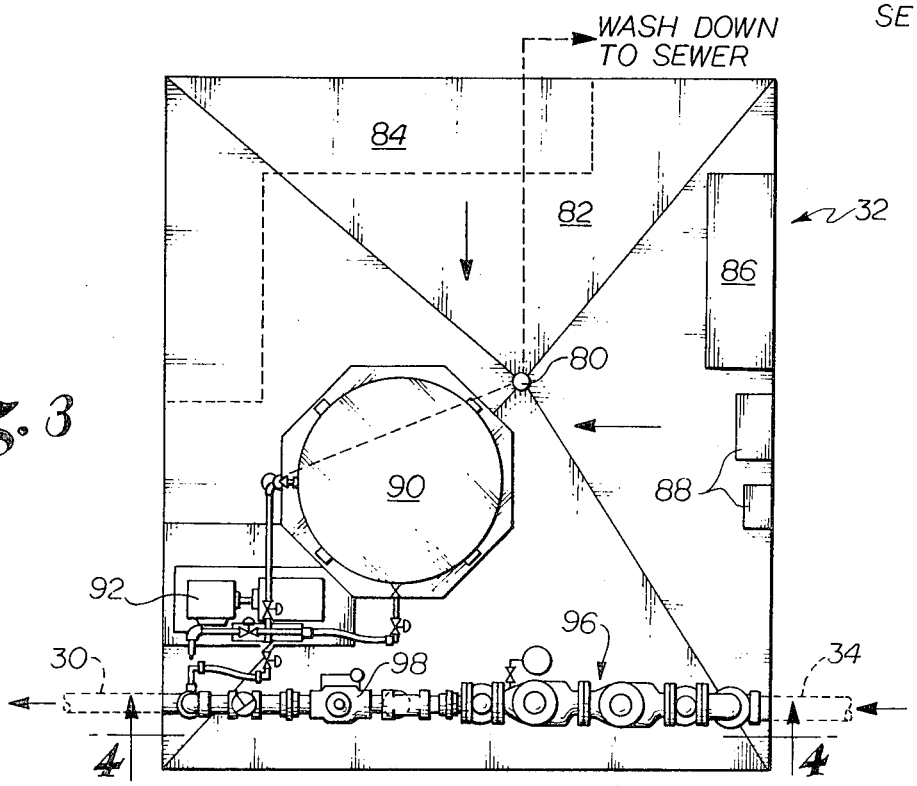
FIG. 3 is a plan view of the preferred control room.

As seen in FIG. 3, the preferred embodiment of the control room is shown. For ease of cleaning, the control room includes a floor drain 80 at the intersection of the various portions of the sloping floor 82. Mounted about the perimeter of the room is fertilizer storage 84 and control panel 86, the required breaker panel and disconnect devices 88. Mounted upon the floor of the control room is the fertilizer holding tank 90 which has mounted adjacent thereto the fertilizer injection pump 92 for selectively injecting the fertilizer into the irrigation feed 30 as explained in greater detail with respect to FIG. 4.

Referring now to FIG. 4, which is a sectional view taken along lines 4—4 of FIG. 3, it is seen that the water supply 34 is located beneath grade, is elevated into the water supply header which includes a wash down hose connection 94, back flow preventer set 96, a strainer and clean out 106, a pressure regulator 98, a test pressure gauge connection 108, a fertilizer injection valve 100 and a pump purge feed connection 102, in addition to manual isolating shutoff valves 104.

In FIG. 5, a plan view of a valve station, there can be seen that the water level tube 44 extends into the water level sensing unit 110, as described in greater detail hereinafter, and is connected by means of a conduit to the automatic field drain valve 112 which can, as the name implies, be used to remove all liquid from the field as may be required for purging. Just before the automatic field drain valve 112 is a vertical water level sight tube 111 complete with a colored float and transparent casing to allow for visual inspection of the water table level within the field section. Also extending into the valve station is the field section main 10 which at its termination has located an automatic drainage valve 128 which, when open, allows excess water to discharge to the site storm system. The liquid make-up supply to the field section main 10 is through the irrigation feed 36 which includes an irrigation feed line drain 116. Also to be noted in view is a bleed line 118 for pressure assisting the automatic valves.

Looking now at FIG. 6, which is a sectional view taken along lines 6—6 of FIG. 5, it can be seen that the valve station lies below the field elevation and as noted in FIG. 1, is outside the playing boundaries and further, outside the boundaries of the controlled field. The valve station includes a closing cap 120 and is surrounded by means of a rigid side 122 and a floor 124. As seen in this view, the water level tube 44 extends outwardly generally toward the field and within the manhole chamber it terminates with the automatic drain valve 112 which is immediately preceded by the water level sight tube 111. The field section main 10 as seen in this view, lies immediately in front of the water level tube 44 and terminates with the automatic discharge valve 128. Further to be seen in this view, is the irrigation supply to the section mains 10 following the irrigation feed line drain 116, shown in FIG. 5, is a strainer and clean out 119, bleed line shut-off 118, automatic irrigation supply valve 126, a balancing valve 127 and a test pressure gage connection 129. The discharge to the storm system is designated 36.

The water level sensing unit for use in the totally automatic system is seen in FIG. 7 and as seen, this also lies beneath the field elevation and is covered by a removable cap 130 which covers a vertically placed PCV pipe 132. A plurality of reed switches 134 are mounted and sealed in a vertical member 135. A buoyant toroidal shaped float 136 having permanent magnets 137 imbedded therein closes the reed switches 134 by magnetic flux which opens and closes the LV=low voltage electrical switches in the terminal base 138 which relays a signal to the main control panel which in turn actuates valves to add or remove liquid from the field. The liquid level within the water level sensing unit is directly responsive to the level within the field. This unit in conjunction with the water level detector 42 and the interconnecting conduit 44 form a U-tube. Tube 44, lying at the lowest portion of the section may be used as a drain for purging the field by opening the automatic field drain valve 112 shown in FIG. 5 and located within the valve station. Further to be seen in this view, is the connection with the low voltage electrical control system 46 and the conductivity sensor 139 for relaying the condition of the nutrified liquid.

Figure 8:
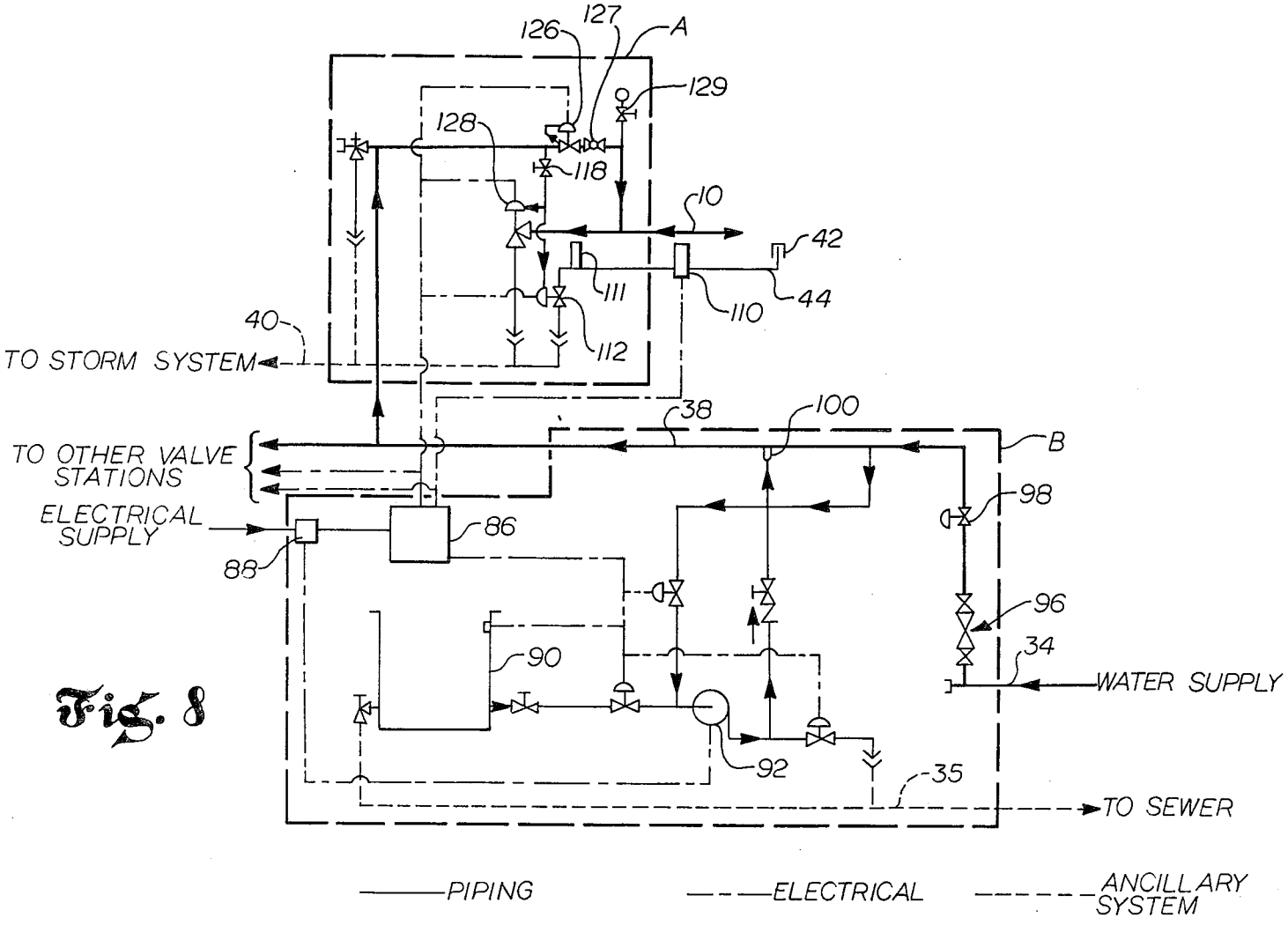
FIG. 8 is a flow diagram for an automated system.

As seen in FIG. 8, the flow diagram is generally divided into two sections (A) which is generally within the valve station and (B) which is generally within the control room. As seen in this view, the water enters the control rooms by means of conduit 34, passes through the back flow preventer 36, pressure regulator 98, and then for purging of the pump, an auxillary line is fed to the fertilizer injection pump 92 with the main line proceeding after the injection valve 100 directly to the valve station via conduit 38. Fertilizer from the holding tank 90 is automatically directed to the fertilizer pump 92 and then through line 38 to the valve stations. Also seen in this view, is a means to purge the pump to the sewer or to dump the storage tank. Within a typical valve station the water passes through the irrigation supply valve 126, the balance valve 127, and then to the field section main 10. The feedback demonstrating a need for water is generated by the water level tube 44 and the water level sensing unit 110. Further to be seen in this view, the electrical supply passes through the power panel 88, the master irrigation control 86, and is fed to the various valving, pumps and water level sensing units necessary to perform the functions as described hereinabove. It is to be remembered that all power except for the pump is low voltage.

Figure 9:
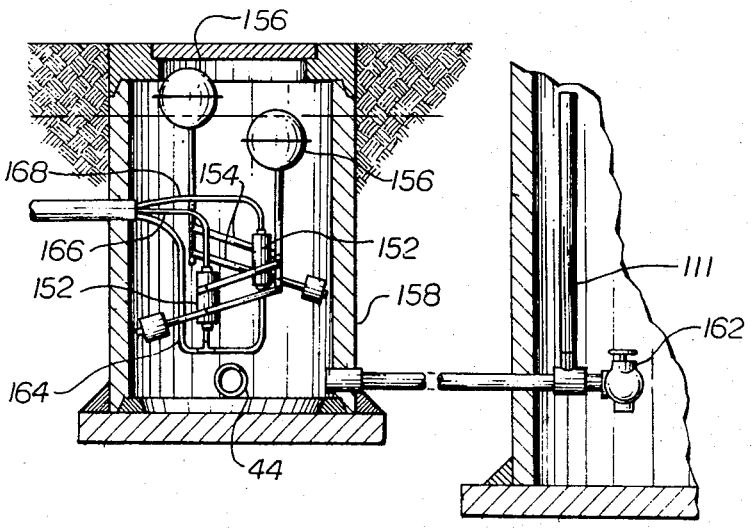
FIG. 9 is an elevational view of an alternate mechanically sensed level control unit.

A preferred control for a system when electrical power is not available is shown in FIG. 9. This installation provides for a mechanically automated system employing a completely controlled method for subsurface drainage and irrigation. With this system, control room is not required and is replaced with a water supply header and an automatic fertilizer application is not contemplated and thus is not included. The control utilizes mechanically functioning float activators 152 linked by parallel linkage 154 to floats 156 all mounted within a manhole 158. A water level tube 44 continues through the control manhole and terminates as for the automatic system in the valve station with a water level sight tube 111 and manual drain valve 162. The float activators utilize the water pressure from the irrigation line through bleed lines 164, 166 and 168 to open and close the pressure operated irrigation and drainage discharge valves.

Figure 10:
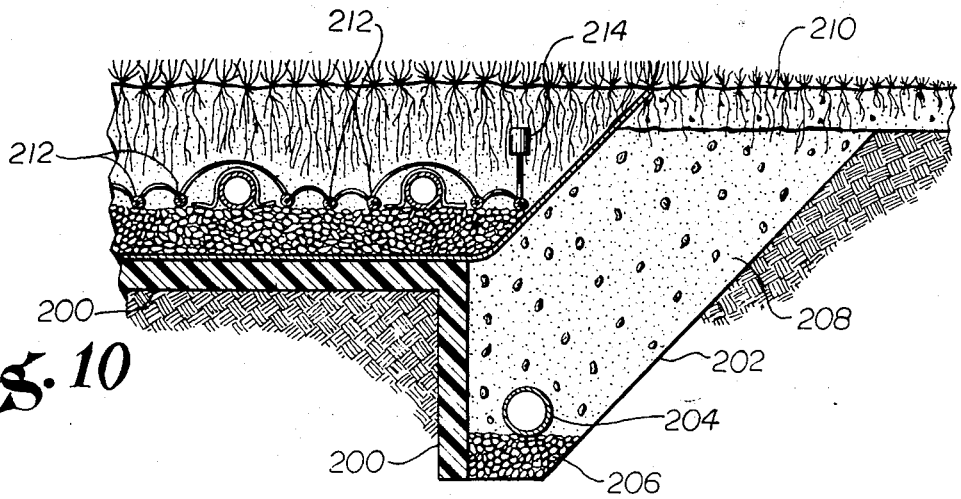
FIG. 10 is a sectional view of an alternate construction when heating and sub-grade insulation is included.

FIG. 10 illustrates, for full disclosure, and alternate embodiment of the extreme right end portion of FIG. 2. Heating cables and sub-grade insulation barrier included as well as a modified periphery of the field. As can be seen, the insulation layer 200 is placed directly under the membrane over the entire field area. At the perimeter this insulation is carried vertically downwards to a location at least 6 inches below the contemplated frost penetration for the locale. The exterior perimeter is trenched 202 to accommodate the insulation and a standard type perimeter drainage system 204. The drainage pipe 204 is bedded on sand 206 and the entire excavation is backfilled to within 6 inches of the surface with free draining select granular fill 208 to ensure elimination of frost heave problems. The surface of the backfilled trench is graded with 6 inches of top soil 210 to support grassing. Referring to the detail within the membrane isolated area, it can be seen that the heating cable system 212 is located over the gravel layer and under the sand layer. The controls for the soil warming system include ground temperature sensor 214 and relay signals back to the main panel in the central room to ensure gradual heat elevation and reduction controls using solid state devices such that the grass root system is not subjected to thermal shock. The heating system when combined with the sub-grade insulation may be used intermittently or continuously throughout the winter as user requirements and economics demand.

Although the completely automatic system has been described in detail, it is to be understood that many of the operations may be handled manually in any one of several combinations. In extremely cold climates, the installation may be enhanced through the use of an insulated membrane or heaters, if necessary as pointed out above. If necessary, the insulation may be used to isolate and keep dry a portion of the subsoil to prevent frost heaving and the subsequent misalignment of the critical elements.

Thus as can be seen, the present system provides a unique method for establishing and maintaining grass play fields with superior long term results and lower overall maintenance and upkeep.

The present system is also useful in solving some of the problems of synthetic surfaces. The term synthetic surface as used herein is intended to include all types of artificial, "non-live" surfaces, including artificial turf, asphaltic mixtures such as rubberized asphalt, other rubberized compositions, certain concrete compositions, and in addition, particulate mixtures, which are typically loose blends of sand in combination with various crushed aggregate material or synthetic particles, such as cinders, which are not cemented together but are compacted in place to the desired surface firmness and texture.

Examples of applications of synthetic surfaces include artificial turf for ballfields, rubberized asphalt and other rubberized compositions for running tracks, cinder running tracks, asphalt playground areas, and concrete tennis courts.

Each of the various synthetic surfaces are affected by weather. Certain weather conditions, specifically rain, sun and frost/snow, are especially detrimental to the surfaces, although to varying degrees. All synthetic surface areas are affected by rainfall to the extent that the surface itself quickly becomes very wet. Frequently, standing puddles of varying sizes develop, due to poor drainage. This interferes with good usage of the area.

There are also problems with high temperature conditions. In a typical synthetic surface installation, heat from the sun is readily absorbed by the synthetic surface, and the temperature of the surface and the immediate surrounding air zone tends to become significantly higher than the ambient temperature. Such conditions make use of the field/area very uncomfortable. Also, such high temperatures significantly affect both the consistency and the resiliency of the synthetic surface. Thus, it is desirable to attempt to prevent extreme temperature increases at the synthetic surface.

The other significant adverse condition is frost/snow, with accompanying freezing of the surface. Typically, synthetic surfaces are susceptible to freezing, a condition which is quite disadvantageous to users of the field or other area. Thus, it is desirable to attempt to limit if not prevent the build-up of frost/snow on synthetic surfaces and freezing of the surfaces.

Synthetic surfaces have recently been developed with improved porosity, which permits penetration of surface water through the synthetic surface. However, the typical construction of the subsurface system, i.e. the material beneath the synthetic surface, prevents adequate drainage of the field. This is true even where there is a network of perforated conduits in the subsurface system to carry away water reaching the conduits. The installation of such a typical subsurface system includes the steps of excavating and then preparation of the surrounding subgrade region. Trenches are then dug in the subgrade to accommodate the conduit which is installed in the trenches and then connected to the external drainage system.

Over the trenches and the surface of the subgrade is laid a layer of graded granule material which forms a solid subsurface base. On the upper surface of the graded material layer is constructed a base of asphalt or concrete to which is bonded the artificial surface material. In the case of a particulate type of synthetic surface, the base of asphalt/concrete is omitted, and a layer of the particulate material is spread and compacted directly over the subsurface base material.

The subsurface base material must have a uniform particle size distribution, with sufficient fines intermixed, to insure that when the subsurface base material is compacted, a firm "non-rutting" surface is produced. A non-rutting surface is essential to permit proper application of the asphalt or concrete base by means of conventional paving and/or spreading equipment. A firm subsurface base is also necessary to support the equipment used to spread the particulate synthetic surface and to insure that there is minimal intermixing of the more expensive particulate surface material with the subsurface base material.

More specifically with respect to the drainage problems of synthetic surfaces, the subsurface base layer described above, because of its particle size distribution, has a relatively low void ratio, which results in a high resistance to movement of liquid in the horizontal direction. This lateral resistance impedes the subsurface base layer's ability to rapidly carry water from the surface to the conduits. Thus, the typical construction of the subsurface base layer is at least partially responsible for the relatively poor drainage of most synthetic surfaces, and also mandates a greater subsurface base depth then would be otherwise necessary for more porous subsurface base layer materials, in order to accommodate the hydraulic head loss.

The ability of the subsurface system to rapidly carry away water from the synthetic surface is often further impaired when asphaltic concrete bases are used, because it is a common practice with such bases to first apply an asphaltic emulsion coat to the subsurface base layer prior to laying the synthetic surface itself. The emulsion coat tends to prevent surface water from reaching the subsurface system of the field, thereby impairing proper drainage. While the drainage problem of synthetic surfaces are generally known, the inventor has identified one of the primary causes of the problem and has attempted herein to develop a feasible solution to the problem.

More specifically with respect to the problem of high temperatures developing at the synthetic surface, it is commonly known that the surface of a synthetic field, and the immediate surrounding environment, on a hot day, is significantly hotter than the ambient temperature. It is also known that the synthetic surface material itself and the asphaltic base therefore absorb heat from the sun. However, the inventor has discovered that the particulate material comprising the subsurface base layer, being dry in warm weather, will act as an insulator between the relatively cool ground of the subgrade and the surface layer. Hence, the heat absorbed by the surface tends to be reflected back away from the surface rather than into the cooler mass of the subgrade. This heat reflection results in the temperature at the synthetic surface being substantially above the ambient temperature, which is a highly undesirable condition.

Figure 11:
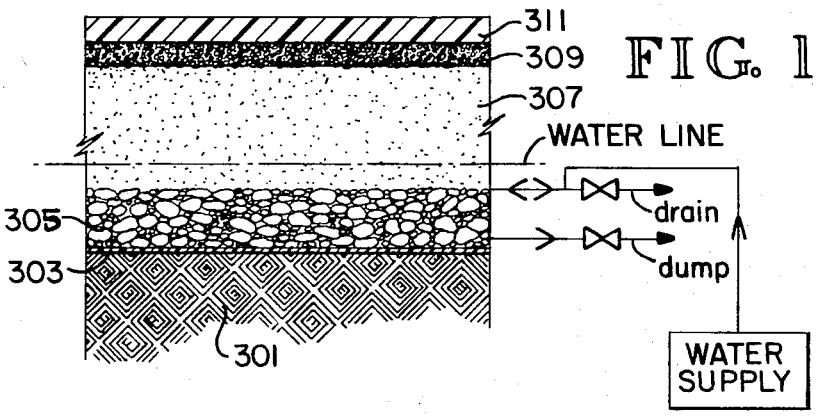
FIG. 11 is a cross-sectional view of a synthetic surface system of the present invention designed for cooling the synthetic surface.

The inventor has found that the above problems are, if not eliminated, to a significant extent solved by the use of an adaption of the present system described above. Referring to FIG. 11, the subgrade region 301 is first excavated and a liquid impervious membrane 303 is then positioned on the subgrade, as explained in more detail in conjunction with the grass surfaces above. The two-layer system of the present invention is then applied on top of membrane 303, and forms the subsurface base for the synthetic surface.

The lower layer 305 is primarily of gravel, having the size range described for the grass surface, while the upper layer 307 is primarily of sand or other similarly fine particulate, having a size range described in connection with the grass surface. The relative particle size of the material comprising the respective lower and upper layers 305 and 307 is such that the particulate comprising the top layer 307 will only nominally penetrate the particulate comprising the lower layer 305, thereby maintaining the void ratio of the particulate of the lower layer. This relationship is similar to that described above for a grass surface installation. A water conduit system (not shown) can be positioned at various levels within the subsurface base system, including in the lower layer or on the top surface of the lower layer, again as shown earlier in this specification in conjunction with a grass surface.

The material comprising the upper layer can be any fine particulate material, such as sand, which exhibits good vertical liquid movement characteristics and which thus has a good capillary rise characteristic, such that liquid is lifted upwardly vertically through the material. Also, surface water will move rapidly downwardly through such a layer. The lower layer must be a particulate, such as pea gravel, which exhibits good lateral fluid movement characteristics, so that liquid in the lower layer is distributed rapidly and substantially uniformly in the horizontal direction over the area of the lower layer.

An asphaltic or concrete base 309 is then applied to the top surface of the upper layer 307 of the subsurface base system, and a synthetic surface layer 311, such as artificial turf, is then applied on top of base 309. With the arrangement shown in FIG. 11, surface water will generally move without any accumulation through the synthetic surface, at a rate which depends upon the permeability of the particular synthetic material. The water will move substantially uniformly downwardly through the upper layer 307, resulting in a uniform rise in the water table in the lower layer 305, due to the rapid and substantially uniform horizontal movement of the water after it reaches the lower layer. The high void ratio of the particulate comprising the lower layer is responsible for quickly equalizing the water level in the subsurface base system. The low resistance to lateral movement of liquid in the lower layer 305 also minimizes the effect of the hydraulic head factors.

The water then exits the contained subsurface base region by means of the conduit system which is in direct communication with the lower layer. Generally, the depth of the subsurface base region for the system of FIG. 11 will be less for a given discharge rate than that of existing systems, and hence, conduits can be centered at larger distances to carry water from the lower layer to the discharge system.

Figure 12:
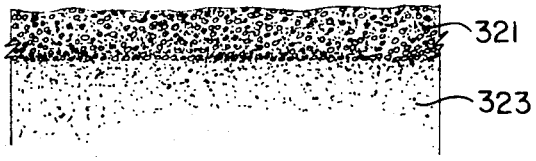
FIG. 12 is a cross-sectional diagram showing a portion of the system of FIG. 11 as adapted for a particular synthetic surface.

The above described subsurface base system is also effective where the synthetic surface is particulate, such as cinders. FIG. 12 illustrates such a use of the system, showing a particulate synthetic surface 321 applied directly to the top surface of the upper particulate layer 323 of the subsurface base system. Layer 323 in the embodiment shown is primarily sand. The remainder of the system for particulate synthetic surfaces is similar to that shown in FIG. 11.

As mentioned above, the inventor has discovered that the particulate material typically used in the subsurface base of conventional synthetic fields, being a mixture of gravel, sand, and fines, will act as a heat insulator when dry, which results in significantly elevated temperatures at the synthetic surface when the ambient temperature is high. By use of the system of the present invention, however, the temperature at the synthetic surface can be prevented from rising significantly above ambient. This is done by supplying liquid to the upper particulate layer 307, so that it is continually moist to a desired degree of saturation.

It is known that water and hence moist particulate are good conductors of heat, and therefore, by keeping the upper particulate layer moist, the subsurface system, particularly the upper particulate layer thereof, acts as a heat conductive body, transmitting heat from the synthetic surface throughout the subsurface system and even the subgrade. Thus, the heat which is absorbed by the synthetic surface is dissipated through the relatively cool subgrade mass, thereby substantially preventing large increases in the temperature at the synthetic surface by reducing the amount of heat radiated back to the air from the surface.

In addition to conducting heat from the synthetic surface to the subgrade, the described system prevents high temperatures at the surface of evaporation. The relatively high porosity of many synthetic surfaces permit evaporation through the surface from the moist upper particulate layer located below the surface. The evaporation of water from the upper particulate layer to the atmosphere produces a further cooling effect on both the immediate synthetic surface area and the surrounding air. The evaporation rate may be controlled by adjusting the level of saturation of the upper particulate layer. The water in the upper particulate layer which is evaporated is continually replaced by virtue of the phenomenon of capillary rise of water from the reservoir of liquid in the subsurface system.

A moist upper layer in the subsurface system also has a positive effect with particulate type surfaces such as cinders. The moisture from the upper layer will be absorbed by the particulate surface, which will help prevent the particulate surface from drying out and creating dust.

Moistening the upper particulate layer in the subsurface system requires an external supply of water connected to the subsurface region's conduit system. The conduits would normally be fitted with automatic valves at their external ends, i.e. outside the area of the surface, so that the subsurface region can be closed off to form a self-contained liquid reservoir within the region bounded by the liquid impervious membrane. When water is added to the conduits, it flows out of the conduits into the lower particulate layer, forming the reservoir of liquid. By maintaining the water table within the lower portion of the upper layer of the subsurface system, water will continue to move substantially uniformly upwardly through the upper particulate layer to the surface by virtue of the capillary rise characteristics of the upper particulate material. The level of the water table in the reservoir, which can be monitored as described earlier in the specification, can be adjusted to change the saturation level in the upper particulate layer. For instance, in a case of high humidity, the water table can be lowered to minimize evaporation. Hence, the cooling system is somewhat adjustable to the climate.

The use of control valves in the conduits, with an external supply of water, permits an additional cooling capability which is useful when evaporation is not desirable. The water in the liquid reservoir can be continuously circulated by alternately opening and closing the control valves, so that warm water is removed from the subsurface reservoir and cooler water is added to the reservoir. This circulation of water will help cool the surface.

Figure 13:
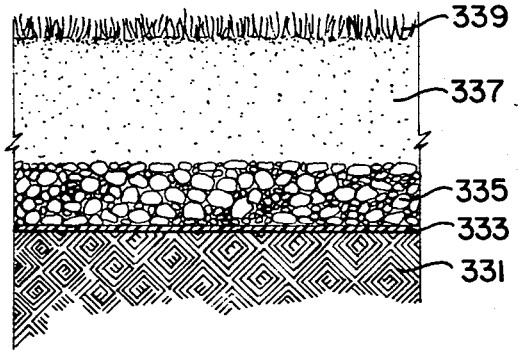
FIG. 13 is a cross-sectional diagram of a synthetic surface system of the present invention which is designed to prevent rutting of the top surface of the base layer.

As stated above, it is known that a subsurface system such as that shown in FIGS. 11 and 12 is not capable of supporting the heavy machinery necessary to apply the synthetic surfaces and the base therefor on a large scale, practical basis. The top surface of the upper particulate layer would rut with the use of heavy machinery. The necessary firm, non-rutting surface is provided in the embodiment shown by initially seeding the exposed top surface of the upper particulate layer with a light planting of natural grass. An upper layer of sand as disclosed herein is capable of growing a rapid catch crop of grass. Typically, if one of the new perennial rye or other fast germinating type grasses is used, the root development of the grass will be sufficient in two to three weeks to firmly bind the particles of the top surface of the upper layer to form the required non-rutting surface. A representative field is shown in FIG. 13 with a grass top layer. The subgrade 331 has a membrane 333 on its surface, and the two layers 335 and 337 of the subsurface system are on top of the membrane. The grass layer 339 is formed at the top surface of upper layer 337.

When the grass is established and cut at least once, it is killed with a conventional grass killer. The synthetic surface is then applied, with a base, if necessary. The dead grass and its root system, beneath the synthetic surface, readily break down and are flushed through the upper and lower layers of the subsurface system and out the drainage system, leaving both layers in the subsurface system with unimpaired void ratios and unimpaired vertical and horizontal fluid movement characteristics, respectively. Because the amount of organic material is at all times relatively small, no settlement of the two layers is experienced upon loss of the organic material.

It should be understood that although the use of a grass layer to bind the top surface of the upper particulate layer is specifically described, other binder or emulsion materials can be used which provide the same binding effect to produce a firm, non-rutting surface. However, it is important that the binder material be such that it will readily flush out through the subsurface system and out the conduit drain following application of the synthetic surface. Such a characteristic is necessary to maintain the good vertical movement of liquid characteristic in the upper layer and to maintain the void ratio of the particulates of both layers. Otherwise, the binder would act to some extent as a liquid barrier at the top surface of the upper particulate layer, obviating the beneficial results of the present subsurface system.

Synthetic surfaces are conventionally heated to prevent freezing or build-up of snow and/or ice by networks or grids of electrical cables. Close spacing of the grid is necessary to produce the desired uniformity of temperature to prevent freezing. However, such systems, using electrical energy, are expensive to install and operate. Also, peak electrical usage typically coincides with the use of the playing surface, thereby increasing the power load on the electrical supply system. This results in larger unit operating costs then if the same amount of energy was spread over an extended period at non-peak periods. Thus, present electrical methods are typically quite expensive, even if they do operate well.

An alternative system to the electrical heating grid is a grid of hot water or steam pipes, which are supplied with hot water or steam by a central source. However, it is generally considered to be impractical to heat such a large surface, such as a playing field, by such a system. As with the electrical grid system, a relatively closely spaced network is required for uniformity of heating, and there is also the risk of the system freezing when not in its heating mode.

Figure 14:
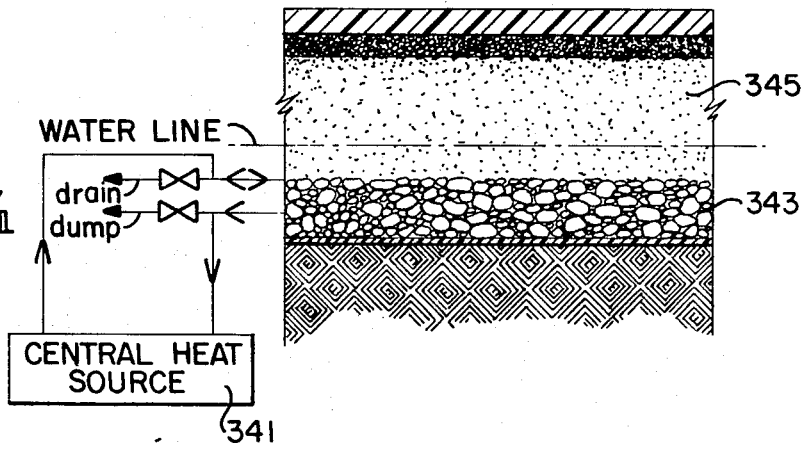
FIG. 14 is a cross-sectional view of a synthetic surface system of the present invention designed for heating the synthetic surface.

However, by using the two-layer subsurface system with conduits described above, with a contained reservoir in which a water table is maintained, a large synthetic surface area, such as a playing field, can be efficient heated without a network of electrical cables or steam pipes. Referring to FIG. 14, water can be heated remotely in a central heating plant 341 and piped into the conventional conduit system in the subsurface base region. The horizontal conduit network will, as described above, typically be laid on the top surface of the lower particulate layer 343 or the conduits may be in the lower layer itself. The water table in the reservoir, with the particulate of the subsurface system, acts in effect as a large heat sink. Warm water is circulated throughout the subsurface base region, resulting in a gradual and uniform transfer of heat to the surface layer. This has the advantage that the surface will continue to receive heat during usage of the field from the warm subsurface base region, without the necessity of using energy to heat the subsurface region at the particular time of peak energy usage.

The use of a remote, central heating source also makes possible the use of a variety of energy sources, including energy derived from waste products.

In operation, the heated water from the main header at the central heating source will be directed into the symmetrical drainage conduit system in the subsurface base region. As the warm water enters the conduit system, some of the water will leave the conduit, through the perforations therein, in the center portion of the system. A slight hydraulic hump is thereby created in the water table in the reservoir at the central portion. This relatively small increase in pressure in the central portion of the system relative to the perimeter portions of the system, tends to direct the low-pressure flow of warm water in the conduits to exit the conduit system, through the perforations, at the system perimeter. When the inflow of water is terminated, the water table in the reservoir rapidly becomes horizontal due to the influence of gravity and the good lateral fluid movement characteristics of the particulate in the lower layer.

When the exit or dump valve of the conduit system is opened, water initially moves out of the reservoir from the lower center portion of the water table. This causes a slight hydraulic dish in the lower central portion of the water table, which in turn causes the water at the perimeter of the water table, which is warmer, as explained above, to move from the perimeter through the lower gravel layer to the central portion of the field. When the exit valve is closed, the water table again becomes horizontal.

The regular alternate cycling of inflow and outflow results in a circulation of the warm water throughout the water table. The warm water will flow first to the top central portion of the water table, from there to the perimeter of the water table, on the inflow cycle, and then down through the water table and back through the gravel layer to the lower central portion of the water table on the outflow cycle. Thus, an effective circulation of the inflowing warm water is achieved, resulting in the heating of the entire water table. In the circulation process, heat is transferred from the circulating water directly to the lower gravel layer 343 and then, by capillary rise action, to the upper sand layer 345. The heat sink effect of the water table in the lower particulate layer moderates the cyclical heat transfer produced by the alternating inflow and outflow of water, so that the synthetic surface is supplied with heat on a fairly uniform and gradual basis, with heat moving upwardly from the particulate heated by the warm water in the reservoir.

The low flow pressures, i.e. a few PSI along with the relatively large cross-sectional area of the distribution pipes are helpful in producing the required circulation. Also, the good lateral flow fluid characteristics of the gravel particulate in the lower layer are significant. At the central heating source, the water is passed through a tank, designed to accommodate the required flow volume which is equipped with heat exchangers. The heat exchangers, fired by the central heat source, add heat to the water before the water is returned to the field conduit system. The level of the water table in the reservoir may be controlled through the conduit system. Water may be added if necessary, or deleted, if melting snow raises the water level.

The various features of the system described above can be periodically added to the basic two layer subsurface base system. For instance, a two layer subsurface base system, with a conduit network, may initially be constructed solely for drainage. Such a system can be readily upgraded at a later date to one having a cooling and then a heating capability. An external valve system, with appropriate water supply, headers, and controls are necessary to implement the cooling system described above, while a central heat source and a heat exchange system are necessary for the heating system. All systems, however, use the same two layer subsurface base system having the characteristics described. Furthermore, upgrading the system in the manner described above, requires no reworking of the synthetic surface and use of the surface remains unimpaired during the upgrading operations.

Thus, the present system is also practical and useful with synthetic surfaces, as well as grass surfaces. Although a preferred embodiment of the invention has been disclosed herein for purposes of illustration, it should be understood that various changes, modifications and substitutions may be incorporated in such embodiment, without departing from the spirit of the invention, which is defined by the claims which follow.

What is claimed is:

1. A method for preventing extreme high temperatures in the vicinity of synthetic surfaces the method comprising the steps of:

preparing a subgrade area to accommodate a subsurface base system on top of which is applied the synthetic surface, the subsurface base system comprising an upper layer of primarily sand-containing particulate material which has good capillary rise characteristics and in which liquid characteristically moves primarily in the vertical direction, and a lower layer of particulate material located substantially adjacent said upper layer, said lower layer consisting essentially of gravel, in which liquid characteristically moves well in the horizontal direction, as well as downwardly, so that liquid in the lower layer tends to disperse in the horizontal direction relatively rapidly and uniformly, wherein the physical characteristics of the essentially gravel particulate material of said lower layer and the primarily sand-containing particulate material of said upper layer are such that the sand-containing particulate material does not significantly penetrate into the gravel, so that, consequently, the void ratio of the gravel remains substantially unimpaired; and maintaining the particulate in the upper layer sufficiently moist that the heat insulating effect of the otherwise dry particulate is significantly reduced and so that heat at the synthetic surface is effectively transmitted from the surface to the subsurface base region and beyond.

2. The method of claim 1, including the step of establishing a liquid reservoir in the subsurface base system, the level of liquid in the reservoir being maintained within the upper layer of the subsurface base system.

3. The method of claim 2, including the step of raising and lowering the level of water in the upper layer of the subsurface base system in accordance with the environmental conditions.

4. The method of claim 3, including the step of circulating cool water into the liquid reservoir and withdrawing warm water therefrom.

5. The method of claim 1, wherein the synthetic surface is permeable to water.

6. A method for warming a synthetic surface comprising the steps of:

preparing a subgrade area to accommodate a subsurface base system;

applying the subsurface base system on top of said subgrade area, the subsurface base system comprising an upper layer of primarily sand-containing particulate material which has good capillary rise characteristics and in which liquid characteristically moves primarily in the vertical direction, and a lower layer of particulate material located substantially adjacent said upper layer, said lower layer consisting essentially of gravel in which liquid characteristically moves well in the horizontal direction, as well as downwardly, so that liquid in the lower layer tends to disperse in the horizontal direction relatively rapidly and uniformly, wherein the physical characteristics of the essentially gravel particulate material of said lower layer and the primarily sand-containing particulate material of said upper layer are such that the sand-containing particulate material does not significantly penetrate into the gravel, so that, consequentially, the void ratio of the gravel remains substantially unimpaired;

applying said synthetic surface on top of said subsurface base system;

establishing a reservoir of liquid in the subsurface base system; and circulating the liquid in the reservoir by removing cooler water from the reservoir and adding warmer water thereto, wherein the heat in the water in the reservoir is transferred to the particulate in said lower layer and then via capillary action to the particulate of the upper layer and then to the synthetic surface, raising the temperature of the synthetic surface so as to help prevent the freezing of the synthetic surface and the accumulation of frost and snow on the synthetic surface.

7. The method of claim 6, including the step of circulating the water in the reservoir through a conduit system, wherein the water pressure is slightly higher at the center of the reservoir than at its perimeter during the time that water is added to the reservoir, while the water pressure is slightly less at the center of the reservoir than at its perimeter when water is being removed from the reservoir.

8. The method of claim 7, wherein the water pressure is relatively low, on the order of a few PSI.

9. The method of claim 7, wherein the warmer water added to the reservoir through the conduit will flow first to the top central portion of the reservoir, and from there to the top perimeter of the reservoir, then down to the lower perimeter of the reservoir, and then back to the lower central portion of the reservoir, and from there out of the reservoir.

10. A method for applying a synthetic surface to a subsurface base system which would otherwise be ruttable by conventional machinery for applying a synthetic surface, the method comprising the steps of:

creating a binder layer at the upper surface of the subsurface base system sufficiently firm to support the conventional machinery without substantial rutting; and treating the binder layer so that it passes through the subsurface base system following application of the synthetic surface, without substantially impairing the liquid movement characteristics of the subsurface base system.

11. The method of claim 10, wherein the binder layer is conventional grass, and wherein the method includes the step of killing the grass after it has germinated, prior to adding the synthetic surface to the top of the base system.

12. A system for draining liquid from a synthetic material surface, comprising:

a subsurface base system, on top of which is applied the synthetic surface, the subsurface base system comprising an upper layer of primarily sand-containing particulate material in which liquid characteristically moves primarily in the vertical direction, and a lower layer of particular material located substantially adjacent said upper layer, said lower layer consisting essentially of gravel, in which liqud characteristically moves well in the horizontal direction, as well as downwardly, so that liquid at the top surface of said upper layer tends to move rapidly downwardly into said lower area, where it tends to disperse rapidly horizontally, wherein the physical characteristics of the essentially gravel particulate material of said lower layer and the primarily sand-containing particulate material of said upper layer are such that the sand-containing particulate material does not significantly penetrate into the gravel, so that consequently, the void ratio of the gravel remains substantially unimpaired; and means providing liquid communication between said lower layer and a point outside the boundary of the surface to be drained.

13. The system of claim 12, wherein the synthetic material surface is permeable to liquids.

14. The system of claim 12, including means for establishing a liquid reservoir within the subsurface base system.

15. The system of claim 12, wherein the liquid communication means is a system of conduits positioned within the liquid reservoir and connecting the liquid reservoir to said point outside the boundary of the surface to be drained.

16. A system for preventing extreme high temperatures in the vicinity of synthetic surfaces the system comprising:

a subgrade area;

a subsurface base system on top of said subgrade area, to the top of which base system is applied the synthetic surface, the subsurface base system comprising an upper layer of primarily sand-containing particulate material which has good capillary rise characteristics and in which liquid characteristically moves primarily in the vertical direction, and a lower layer of particulate material located substantially adjacent said upper layer, said lower layer consisting essentially of gravel, in which liquid characteristically moves well in the horizontal direction, as well as downwardly, so that liquid in the lower layer tends to disperse in the horizontal direction relatively rapidly and uniformly, wherein the physical characteristics of the essentially gravel particulate material of said lower layer and the primarily sand-containing particulate material of said upper layer are such that the sand-containing particulate material does not significantly penetrate into the gravel, so that, consequently, the void ratio of the gravel remains substantially unimpaired; and means establishing a liquid reservoir in said subsurface base system in such a manner that the particulate of said upper layer remains sufficiently moist that the heat-insulating effect of the otherwise dry particulate is significantly reduced and so that the heat at the synthetic surface is effectively transmitted from the synthetic surface to the subsurface base system and beyond.

17. The system of claim 16, wherein the synthetic surface is permeable to water.

18. The system of claim 17, including means for raising and lowering the level of water in the upper layer of the subsurface base system in accordance with the environmental conditions.

19. The system of claim 18, including means for circulating relatively cool water into the liquid reservoir and withdrawing relatively warm water therefrom.

20. A system of warming synthetic surfaces, comprising:

a subgrade area;

a subsurface base system on top of said subgrade area, to the top of which base system is applied the synthetic surface, the subsurface base system comprising an upper layer of primarily sand-containing particulate material which has good capillary rise characteristics and in which liquid characteristically moves primarily in the vertical direction, and a lower layer of particulate material located substantially adjacent said upper layer, said lower layer consisting essentially of gravel in which liquid characteristically moves well in the horizontal direction, as well as downwardly, so that liquid in the lower layer tends to disperse in the horizontal direction relatively rapidly and uniformly, wherein the physical characteristics of the essentially gravel particulate material of said lower layer and the primarily sand-containing particulate material of said upper layer are such that the sand-containing particulate material does not significantly penetrate into the gravel, so that, consequentially, the void ratio of the gravel remains substantially unimpaired;

means establishing a liquid reservoir in the subsurface base system; and means circulating the liquid in the reservoir by removing relatively cool water from the reservoir and adding relatively warm water thereto, wherein the heat in the water in the reservoir is transferred to the particulate in said lower layer and then via capillary action to the particulate of the upper layer and then to the synthetic surface, which results in the temperature of the synthetic surface being raised, thereby tending to prevent the freezing of the synthetic surface and the accumulation of frost and snow on the synthetic surface.

21. The system of claim 20, wherein the water in the reservoir is circulated by means of a conduit system, and wherein the water pressure is slightly higher at the center of the reservoir then at its perimeter during the time that water is added to the reservoir, while the water pressure is slightly less at the center of the reservoir than at its perimeter when water is removed from the reservoir.

22. The system of claim 21, wherein the water pressure is relatively low, on the order of a few PSI.

* * * * *